US005305893A

United States Patent [19]

Hereford

[11] Patent Number: 5,305,893

[45] Date of Patent: Apr. 26, 1994

[54] CONVEYOR SYSTEM INCLUDING FLOW DIVERTER MEANS

[75] Inventor: Cliff E. Hereford, Haddock, Ga.

[73] Assignee: Brown & Williamson Tobacco Corporation, Louisville, Ky.

[21] Appl. No.: 767,722

[22] Filed: Sep. 30, 1991

[51] Int. Cl.[5] ..... B07C 5/00

[52] U.S. Cl. ..... 209/577; 209/652; 209/653; 209/657; 198/372

[58] Field of Search ..... 209/576, 577, 590, 657, 209/638, 931, 651, 652, 653, 656, 687, 920; 198/367, 372

[56] References Cited

U.S. PATENT DOCUMENTS

| | | | |
|---|---|---|---|
| 1,878,315 | 9/1932 | Phelps | 209/654 |
| 3,216,567 | 11/1965 | Kelly et al. | 209/920 X |
| 3,265,208 | 8/1966 | Reniker et al. | 209/655 X |
| 4,236,640 | 12/1980 | Knight | 209/577 X |
| 4,281,764 | 8/1981 | Fowler et al. | 209/657 X |
| 4,576,286 | 3/1986 | Buckley et al. | 209/576 X |

FOREIGN PATENT DOCUMENTS

| | | | |
|---|---|---|---|
| 1423552 | 2/1976 | United Kingdom | 209/657 |

*Primary Examiner*—D. Glenn Dayoan

*Attorney, Agent, or Firm*—Charles G. Lamb; Charles I. Sherman

[57] ABSTRACT

A conveyor system for moving small particles of material from one location to another includes a flow diverter to divert the flow leaving a first conveyor to a second or third conveyor wherein one of the second or third conveyors is a reject conveyor to remove that material which includes foreign objects therein. The flow diverter is operated in response to a foreign object detection device which is operable in response to material moving along the first conveyor wherein the information obtained from the foreign material detecting device is received in a computer, wherein the computer actuates a piston operated air cylinder to move a perforated sheet member from one location to another so that the flow of material from the first conveyor or any part of the material leaving the first conveyor may be diverted to a reject conveyor.

18 Claims, 1 Drawing Sheet

CONVEYOR SYSTEM INCLUDING FLOW DIVERTER MEANS

BACKGROUND OF THE INVENTION

The invention relates to flow diverter means for diverting flow of solid materials in a gas stream from one conveying system to another. More particularly, the present invention relates to a conveying system which includes means for diverting the flow of product from one conveying system to a second conveying system.

Conveying systems are well known for transporting materials throughout manufacturing facilities in order to get the materials from one area to another. Particularly in the processing of tobacco, conveying systems are utilized throughout the manufacturing facilities to convey the tobacco leaf coming in all the way through each of the processing steps until a finished cigarette product in package and carton form is shipped. However, in the conveying of leaf or cut tobacco from one station to another in the processing line, many times contaminates are found in the tobacco which are difficult to remove, particularly when the contaminants are of substantially the same size and shape as the tobacco, and, screening means are not effective to remove this foreign material from the tobacco. One archaic method to remove this foreign material which is still in use is to have a laborer stationed along the conveying means to physically remove the pieces as they go by. Another separating method is set forth in U.S. Pat. No. 4,657,144 wherein foreign material, such as string and paper, are detected in tobacco processing lines and as the contaminated tobacco cascades from one conveying means to another conveying means, a blast of air is directed to the portion of the cascade in which the foreign material is located. Even another means being used is to drop the tobacco, along with the foreign material, through a separating device which separates the foreign material from the tobacco, based upon the different densities of the two products. However, whenever the foreign material and the tobacco are of substantially the same size and density, this of course does not work.

SUMMARY OF THE INVENTION

The present invention provides a conveyor system including means to remove foreign materials from a product line.

More particularly, the present invention provides a novel flow diverter which is operable in response to the detection of foreign material in product in a conveying system to divert the portion of the product containing the foreign material onto a reject conveying system.

Even more particularly, the present invention provides a conveyor system including a flow diverter comprising: a first conveyor means spaced from and disposed vertically above a second and third conveyor means wherein the second and third conveyor means are transverse to the first conveyor means and positioned at a discharge end of the first conveyor means. The flow diverter means is disposed in the spacing between the first conveyor means and the second and third conveyor means, and includes means to control the flow of materials from the first conveyor means to either the second or third conveyor means.

BRIEF DESCRIPTION OF THE DRAWINGS

A better understanding of the present invention will be had upon reading the following description in conjunction with the accompanying drawings in which like parts are identified by like number and wherein.

DETAILED DESCRIPTION OF A PREFERRED EMBODIMENT

Figure 1:
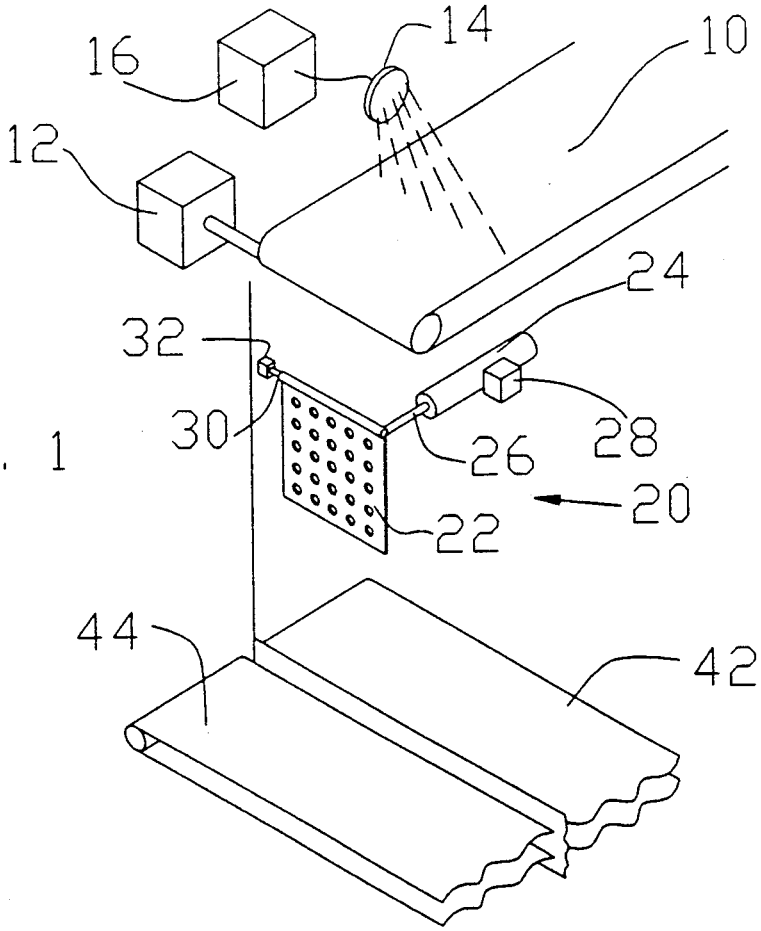
FIG. 1 is a perspective view of a conveyor system embodying the present invention.

In FIG. 1, a vibrating conveyor identified by the numeral 10 is provided to convey tobacco past a detection means to detect foreign material that is disposed within the tobacco. The means to detect foreign materials in the tobacco can be any type of detection means known in the art and is identified in FIG. 1 by the numeral 14. The detecting means 14 is exemplified as a camera which operates in response to an infrared scanner source or it may be a sonic device which uses sound waves to detect foreign materials in the tobacco stream. As materials pass through the detecting zone for the detection device 14, the detection device 14 provides information to a computer identified by the numeral 16 so that if the material passing thereby includes foreign objects therein, the computer 16 is provided with analyzing means to determine the exact location in the vibrating conveyor 10 the foreign objects are located. In turn, the computer 16 actuates solenoid valves 28 and air cylinders 24 which are operable in response to valves 28. Each air cylinder 24 is operably connected to a perforated sheet or paddle 22, a number of which are vertically disposed and in line with the flow of materials discharging from the vibrating conveyor 10.

The perforated sheets 22 are generally hingedly connected along their top portion by a hinge rod 30 which is horizontally mounted across the entire length of the vibrating conveyor 10. The support 32 is provided for attaching the hinge rod 30 thereto so that each perforated sheet 22 when moved outwardly in response to activation of an air cylinder 24, will divert the normal flow of material directed toward transport conveyor 42 to reject conveyor 44.

In a preferred embodiment, there are a plurality of perforated sheets 22 in alignment along the entire discharge end of the vibrating conveyor 10 so that only predetermined portions of the flow of material will be diverted at any given time. Thus, in operation, the computer 16, upon receiving information as to the location of a foreign object in the tobacco flow, can isolate a small portion of the materials coming from the vibrator 10 and therefore only actuate one or two perforated sheets to divert the materials from the conveyor 42 to the reject conveyor 44.

The conveyors 42 and 44 are shown as endless belt type conveyors, wherein the endless belts may be operated by any means, such as electric motors (not shown). Moreover, the conveyors 42 and 44 are disposed transverse to the vibrating conveyor 10 so that when a perforated sheet 22 moves outward and upward the normal flow of tobacco from the vibrating conveyor 10 to the conveyor 42 is diverted to the reject conveyor 44.

Figure 2:
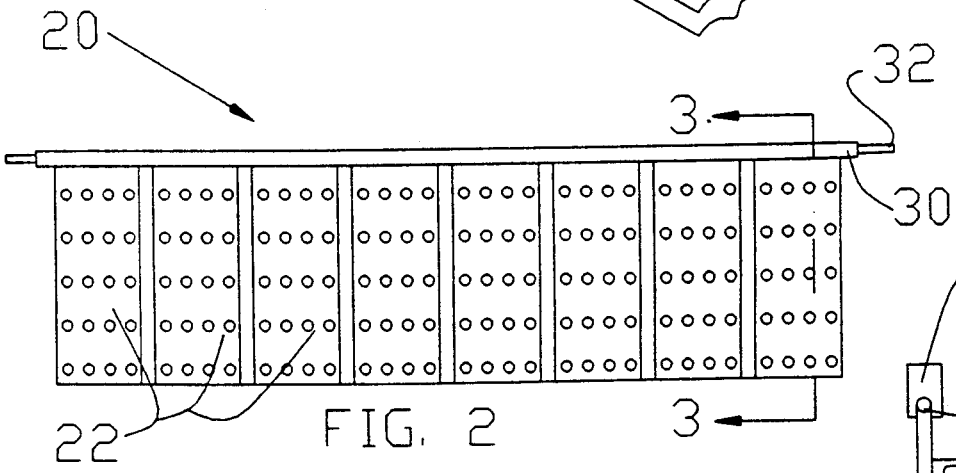
FIG. 2 is an enlarged elevational view of a flow diverter as seen in FIG. 1; and, FIG. 3 is an enlarged cross-sectional view of the flow diverter as seen in the direction of arrows 3—3 in FIG. 2.
Figure 3:
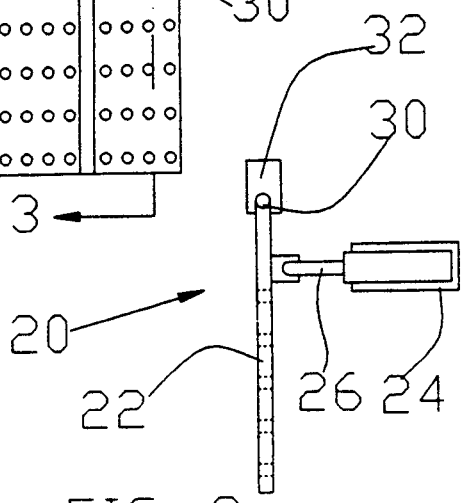

As best shown in FIGS. 2 and 3, the perforated sheet 22 is generally constructed of a mesh screen material wherein the mesh is of sufficient size so that tobacco particles will not flow therethrough, while minimizing the least resistance of the sheet 22 to the air stream containing the material to be diverted.

In operation, the perforated sheet or paddle 22 is operated instantaneously for only a relatatively short period of time to minimize the loss of good product. A perforated sheet is one preferred diverter, but other means which decrease the resistance to air is an important consideration in the design of a flow diverter for the present invention.

The foregoing detailed description is given primarily for clearness of understanding and no unnecessary limitations are to be understood therefrom because modifications will become obvious to those skilled in the article upon reading the disclosure and may be made without departing from the spirit of the invention and the scope of the appended claims.

What is claimed:

1. A conveyor system comprising:

(a) a first conveyor means spaced from and disposed vertically above a second and third conveyor means, said second and third conveyor means being transverse to said first conveyor means and positioned at a discharge end of said first conveyor means; and, (b) a flow diverter means positioned in the spacing between said first and said second and third conveyor means, said flow diverter means including means to control flow of material from said first conveyor means to said second and third conveyor means, wherein said means to control flow from said first conveyor means to said second and third conveyor means includes detecting means in cooperating relationship with means to divert selected portions of flow of material from said first conveyor means to said second and third conveyor means, said means to divert selected portions of said flow of material comprises a plurality of performated sheets aligned in side-by-side relation parallel to the flow of said material.

2. The conveyor system of claim 1 wherein said first conveyor means is a vibrating conveyor.

3. The conveyor system of claim 1 wherein said detecting means includes computing and analyzing means in actuating cooperation with means to divert selected portions of said flow of material.

4. The conveyor system of claim 1 wherein said detecting means includes an infrared scanner.

5. The conveyor system of claim 1 wherein said detecting means includes a sonic device which uses sound waves to detect foreign material in said flow of material.

6. The conveyor system of claim 1 wherein said perforated sheets are operable in response to actuating of selected solenoid valves.

7. The conveyor system of claim 6, said solenoid valves being in actuating relationship with said detecting means.

8. The conveyor system of claim 1 wherein said flow diverter means includes a vertically disposed perforated sheet member hingedly attached to an overhead support adjacent to the discharge end of the first conveyor means, said vertically disposed perforated sheet member being operable in response to a solenoid actuated air piston cylinder.

9. The conveyor system of claim 8 including means to detect foreign material in said first conveyor means and a computer means to evaluate location of said foreign material and actuate said solenoid valve in response to preselected operating conditions.

10. The conveyor system of claim 1 wherein said flow diverter means includes a plurality of vertically disposed perforated sheet members in alignment with each other along the discharge end of said first conveyor means, each of said vertically disposed perforated sheet members being operated independently of each other sheet.

11. A flow diverter comprising:

(a) a vertically disposed sheet member having a plurality of flow-through openings extending longitudinally to the flow of air therethrough, said sheet member being hingedly attached to an overhead support; and, (b) means to move said sheet member.

12. The flow diverter of claim 11 wherein said means to move said sheet member includes a solenoid operated air cylinder.

13. In a conveyor system having a first conveyor spaced from and disposed above second and third conveyor means, said second and third conveyor means being transverse to said first conveyor means and positioned at a discharge end of said first conveyor means, the improvement comprising:

(a) a flow diverter means disposed in the spacing between the first conveyor and the second and third conveyor means, said flow diverter means including means to adjust the flow of materials from the first conveyor means between the second and third conveyor means said means to adjust the flow from said first conveyor means between said second and third conveyor means includes detecting means in cooperating relationship with means to divert selected portions of flow of material from said first conveyor means to said second and third conveyor means said means to divert selected portions of said flow of material comprises a plurality of perforated sheets aligned in side-by-side relation parallel to the flow of said material.

14. The conveyor system of claim 13 wherein said detecting means includes computing and analyzing means in activating cooperation with means to divert selected portions of said flow of material.

15. The conveyor system of claim 13 wherein said detecting means includes an infrared scanner.

16. The conveyor system of claim 13 wherein said detecting means includes a sonic device which uses sound waves to detect foreign material in said flow of material.

17. The conveyor system of claim 13 wherein said perforated sheets are operable in response to actuating of selected solenoid valves.

18. The conveyor system of claim 17, said solenoid valves being in actuating relationship with said detecting means.

* * * * *